US005778966A

United States Patent [19]

Hsieh

[11] Patent Number: 5,778,966

[45] Date of Patent: Jul. 14, 1998

[54] GOLF CLUB HEAD MOLDING APPARATUS

[76] Inventor: Wen Liang Hsieh, P.O. Box 82-144, Taipei, Taiwan

[21] Appl. No.: 632,584

[22] Filed: Apr. 15, 1996

[51] Int. Cl.[6] ..... B22D 19/00; B22D 25/02; B22D 33/04

[52] U.S. Cl. ..... 164/332; 164/340; 164/342; 249/83; 249/95

[58] Field of Search ..... 164/332, 340, 164/342; 249/83, 95, 176

[56] References Cited

U.S. PATENT DOCUMENTS 4,993,475 2/1991 Yamada ..... 164/340

FOREIGN PATENT DOCUMENTS 6-31421 2/1994 Japan ..... 164/340

*Primary Examiner*—J. Reed Batten, Jr.
*Attorney, Agent, or Firm*—A & J

[57] ABSTRACT

The apparatus includes an upper die, a replaceable first core member fixed to the cavity of the upper die by a screw, a titanium face plate for golf club head attached to the first core member and having notches and cuts for binding of molten alloy, a bottom die, and a second core member fixed to the cavity of the bottom die by a screw and having a projecting block raised from the top side corresponding to the sweat spot of the golf club head to be made for forming a hollow structure in the golf club head at the back of the sweat spot.

3 Claims, 4 Drawing Sheets

GOLF CLUB HEAD MOLDING APPARATUS

BACKGROUND OF THE INVENTION

1. Field of the Invention

This invention relates to golf club head molding apparatus, and relates more particularly to such a golf club head molding die in which the core members of the upper die and the bottom die are replaceable subject to the angle and shape of the golf club head to be made.

2. Description of the Prior Art

Conventional metal golf club heads are integrally made from zinc alloy by molding. Nowadays, regular metal golf club heads are commonly mounted with a titanium face plate to improve striking. FIG. 1 shows a metal golf club head of this type. This metal golf club head is made by: molding a club head casing 1 having a coupling flange 11, then preparing a titanium face plate 2 having a coupling flange 21 by stamping, and then fastening the titanium face plate 2 to the club head casing 1 by forcing the coupling flange of the titanium face plate 2 into engagement with the coupling flange 11 of the casing 1. When assembled, the gaps between the titanium face plate and the casing are sealed, and then the assembly is trimmed and polished. This golf club head manufacturing process is complicated. Furthermore, the titanium face plate tends to vibrate or to fall from the casing after a long use.

SUMMARY OF THE INVENTION

According to the preferred embodiment of the present invention, the golf club head molding apparatus comprises an upper die, a replaceable first core member fixed to the cavity of the upper die by a screw, a titanium face plate for golf club head attached to the first core member and having notches and cuts for binding of molten alloy, a bottom die, and a second core member fixed to the cavity of the bottom die by a screw and having a projecting block raised from the top side corresponding to the sweat spot of the golf club head to be made for forming a hollow structure in the golf club head at the back of the sweat spot. Because the first core member and the second core member are replaceable, the angle and shape of the golf club head can be changed by using different core members.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
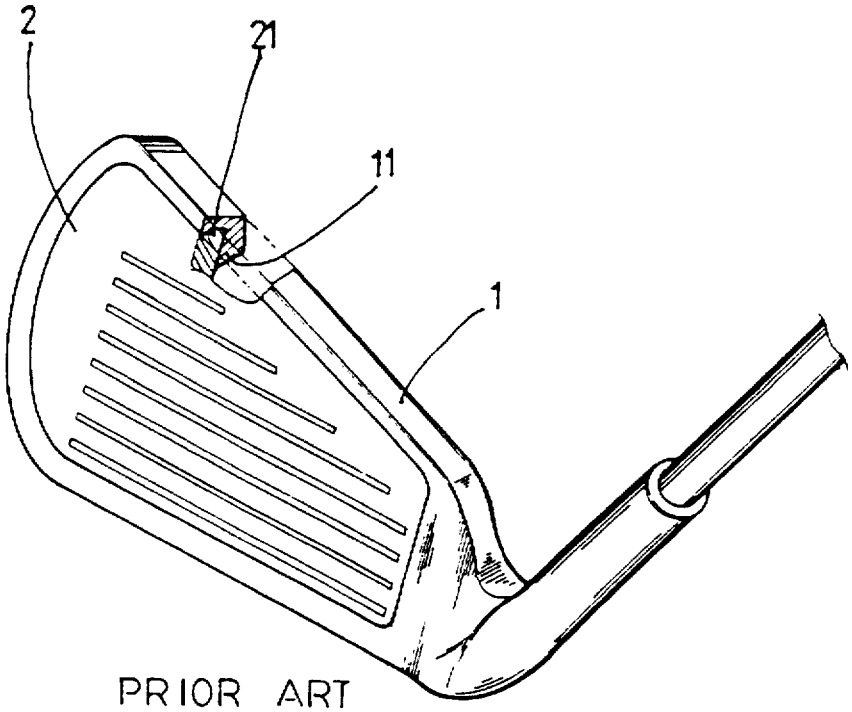
PRIOR ART FIG. 1
FIG. 1 shows the structure of a metal golf club head made according to the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
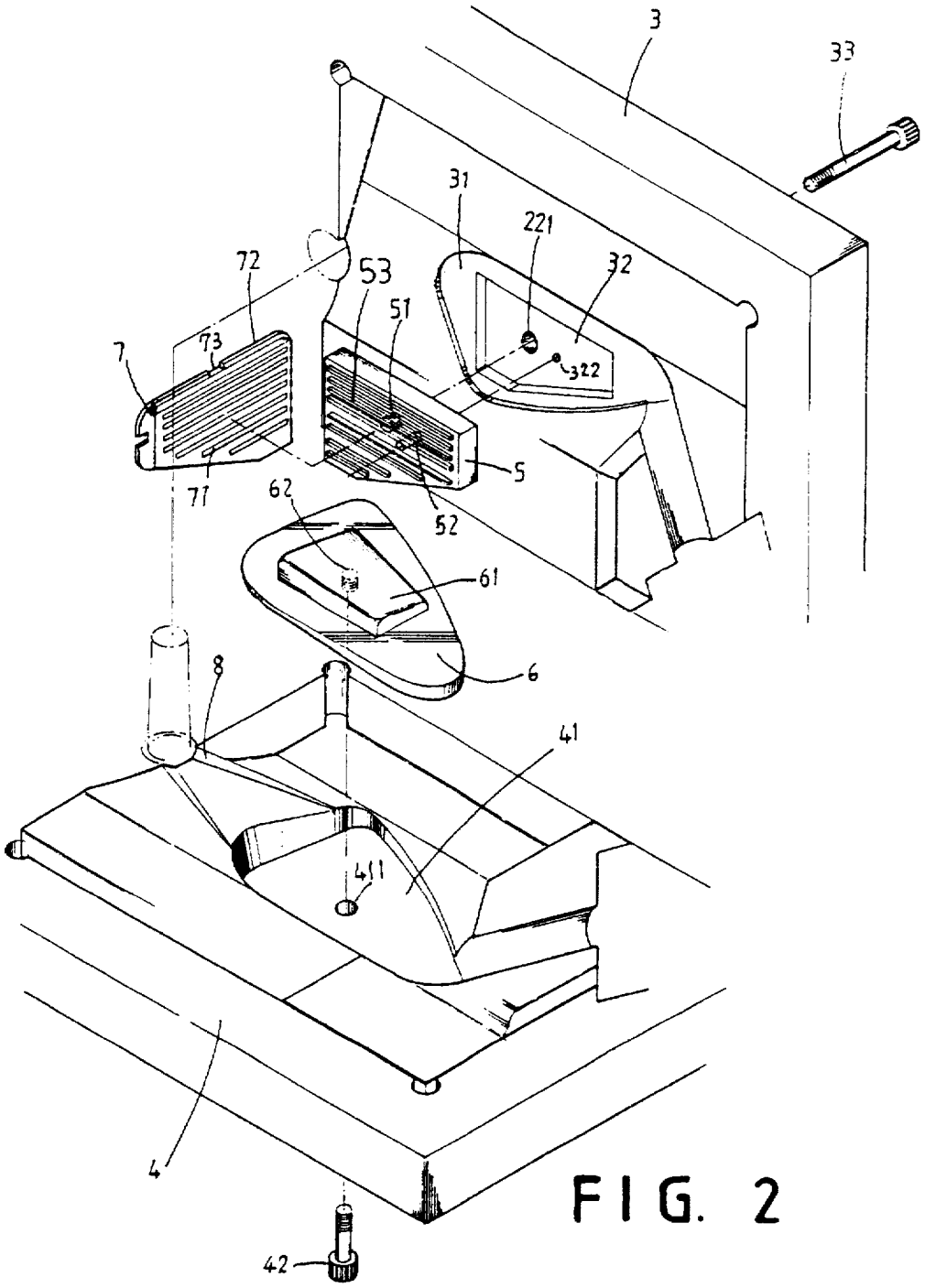
FIG. 2 is an exploded view of a golf club head molding die according to the present invention.
Figure 3A:
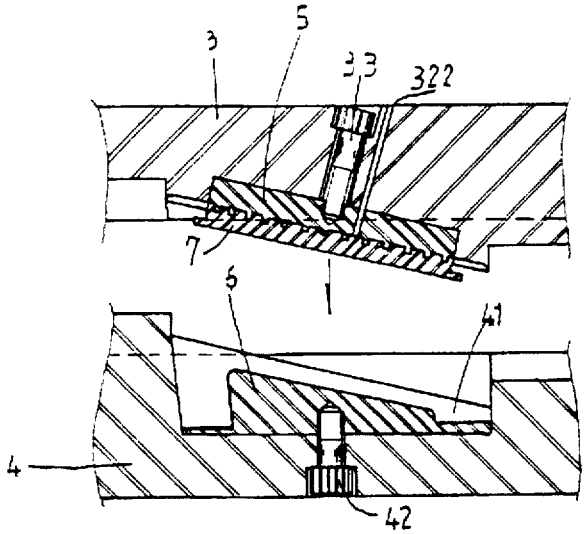
FIG. 3A is a sectional view of the golf club head molding die of the present invention, showing the titanium face plate secured to the core of the upper die.
Figure 3B:
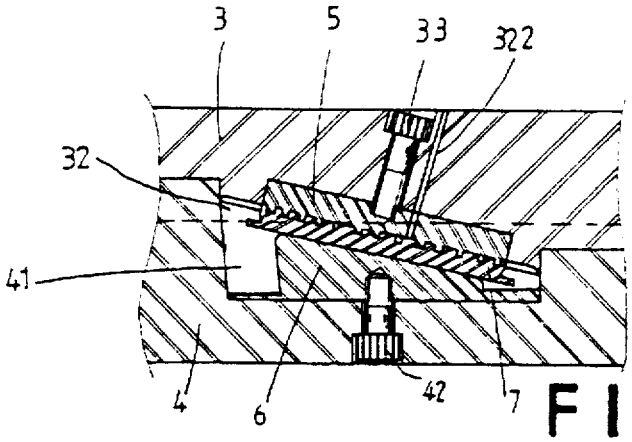
FIG. 3B is similar to FIG. 3A but showing the upper die covered on the bottom die.

Referring to FIG. 2, a gold club head molding die in accordance with the present invention is generally comprised of a upper die 3, a bottom die 4, a first core member 5, and a second core member 6. The upper die 3 has a cavity 31 of predetermined shape, a recess 32 at the bottom of the cavity 31, a screw hole 221 and an air hole 322 through the recess 32. The first core member 5 fits the recess 32 of the upper die 3, having a screw hole 51 at the bottom side connected to the screw hole 221 of the upper die 3 by a screw 33, and a through hole 52 aligned with the air hole 322. The first core member 5 has a grooved face 53 fitting the striped face 71 of a titanium face plate for golf club head, referenced by 7. During the molding process, a suction force is produced from a suction pump and applied to the air hole 322 to suck up the titanium face plate 7. The titanium face plate 7 has a flange 72 along each side, a notch 73 in the middle of the flange 72 at each side, and a bevel cut 74 at each end of the flange 72 at each side (see also FIG. 3D). The bottom die 4 has a cavity 41, and a screw hole 411 through the cavity 41. The second core member 6 is mounted in the cavity 41 of the bottom die 4, having a projecting block 61 raised from the top side corresponding to the sweat spot of the golf club head, and a screw hole 62 at the bottom side connected to the screw hole 411 of the bottom die 4 by a screw 42.

Figure 3C:
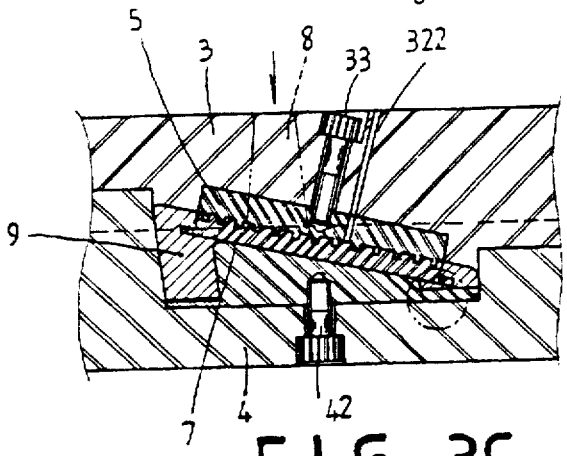
FIG. 3C is similar to FIG. 3B but showing molten alloy filled into the cavities of the upper die and the bottom die.
Figure 3D:
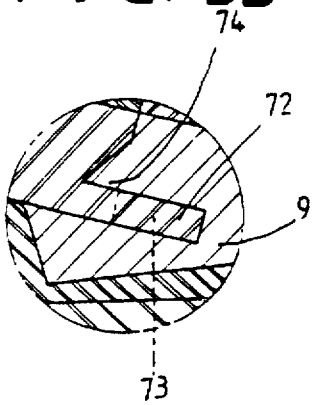
FIG. 3D is an enlarged view of a part of FIG. 3C.
Figure 4:
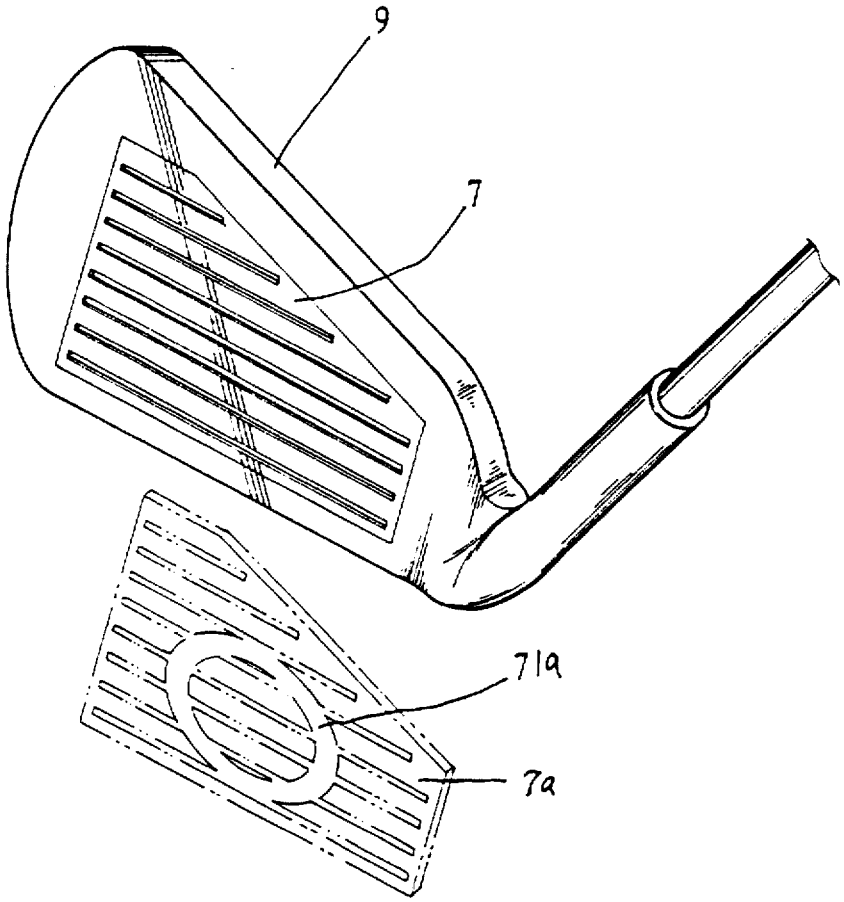
FIG. 4 shows a golf club head made according to the present invention.

When the first core member 5 and the second core member 6 are respectively fastened to the upper die 3 and the bottom die 4, the titanium face plate 7 is attached to the first core member 5 (see FIG. 3A), then the suction pump is operated to suck up the titanium face plate 7 and then the upper die 3 is closed on the bottom die 4 (see FIG. 3B), and then molten alloy is poured through the filling hole 8 (see FIG. 2) into the cavities 31, 41 (see FIG. 3C). After molding, the metal club head body 9 fills up the notch 73 and each bevel cut 74 of the flange 72. Therefore, the titanium face plate 7 and the metal club head body 9 are fixedly secured together.

Referring to FIG. 3B again, the second core member 6 is attached to the back side of the titanium face plate 7, and therefore a hollow structure is formed in the metal club head body 9 at the back of the sweat spot which permits the bearing force of the titanium face plate 7 to be distributed in all directions. Furthermore, a different titanium face plate 7*a* having a differently striped face 71*a* may be used; core members of different shapes may be used so that the angle of the metal club head can be relatively changed.

It is to be understood that the drawings are designed for purposes of illustration only, and are not intended as a definition of the limits and scope of the invention disclosed.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A golf club head molding apparatus comprising:

an upper die having an upper die cavity of predetermined shape, a recess in said upper die cavity at the bottom, a screw hole and an air hole through said recess, said air hole being connected to a suction pump;

a first core member fitted into the recess of said upper die, having a screw hole at a bottom side thereof connected to the screw hole of said upper die by a screw, a through hole aligned with the air hole of said upper die, and a grooved face;

a titanium face plate for golf club head attached to said first core member, said titanium face plate having a flange along each side, a notch in the middle of the flange at each side, a bevel cut at each end of the flange at each side, a striped face forced into engagement with the grooved face of said first core member, and a back side opposing to said striped face;

a bottom die having a bottom die cavity, a screw hole through said bottom die cavity, and a molten alloy filling hole at the periphery in communication with said bottom die cavity; and a second core member mounted in said bottom die cavity, having a projecting block raised from a top side thereof corresponding to the sweat spot of the golf club head to be made and facing said titanium face plate, and a screw hole at a bottom side thereof connected to the screw hole of said bottom die by a screw.

2. The golf club head molding apparatus of claim 1 wherein said second core member is attached to the back side of said titanium face plate so that a hollow structure is formed in the golf club head thus molded at the back of the sweat spot.

3. The golf club head molding apparatus of claim 1 wherein said first core member and said second core member are replaceable so that the angle and shape of the golf club head can be changed by using core members of different shapes.

* * * * *